US006419286B1

(12) United States Patent
Szablewski

(10) Patent No.: US 6,419,286 B1
(45) Date of Patent: Jul. 16, 2002

(54) ROTARY LATCH LOCK, ESPECIALLY FOR MOTOR VEHICLES

(75) Inventor: Piotr Szablewski, Wuppertal (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/581,667

(22) PCT Filed: Dec. 10, 1998

(86) PCT No.: PCT/EP98/08034

§ 371 (c)(1),
(2), (4) Date: Jul. 17, 2000

(87) PCT Pub. No.: WO99/31340

PCT Pub. Date: Jun. 24, 1999

(30) Foreign Application Priority Data

Dec. 16, 1997 (DE) ..... 197 55 695

(51) Int. Cl.[7] ..... E05C 3/06; E05C 3/16

(52) U.S. Cl. ..... 292/216; 292/DIG. 23; 292/DIG. 27; 292/201

(58) Field of Search ..... 292/201, 216, 292/DIG. 27, DIG. 25, DIG. 23; 70/237

(56) References Cited

U.S. PATENT DOCUMENTS

| | | | | |
|---|---|---|---|---|
| 4,492,395 A | | 1/1985 | Yamada | 292/216 |
| 4,869,536 A | * | 9/1989 | Kleefeldt | 292/210 |
| 5,419,597 A | * | 5/1995 | Brackmann et al. | 292/201 |
| 5,494,322 A | * | 2/1996 | Menke | 292/216 |
| 5,603,537 A | * | 2/1997 | Amano et al. | 292/201 |
| 5,634,677 A | * | 6/1997 | Buscher et al. | 292/216 |
| 5,653,484 A | * | 8/1997 | Brackmann et al. | 292/216 |
| 5,802,894 A | * | 9/1998 | Jahrsetz et al. | 70/264 |
| 6,076,868 A | * | 6/2000 | Roger, Jr. et al. | 292/201 |
| 6,079,757 A | * | 6/2000 | Aubry | 292/201 |
| 6,254,148 B1 | * | 7/2001 | Cetnar | 292/201 |

FOREIGN PATENT DOCUMENTS

| | | |
|---|---|---|
| DE | 4321992 | 2/1994 |
| DE | 195 39 726 A1 | 2/1997 |

* cited by examiner

*Primary Examiner*—Lynne H. Browne
*Assistant Examiner*—John B Walsh
(74) *Attorney, Agent, or Firm*—Friedrich Kueffner

(57) ABSTRACT

A vehicle lock has a rotary latch and a closing member cooperating with the rotary latch that is rotatable between a closing position receiving the closing member and an open position releasing the closing member. A pivotable pawl is spring-loaded toward a locking position for securing the rotary latch in the closing position. The pawl has a release position for releasing the rotary latch. Interior, exterior, and safety handles can transfer the pawl into the release position. A common control lever switches the lock between first, second, and third states. The first state is the closing state; vehicle access is authorized via the interior and external handles. The second state is the locking state; access is denied via the exterior handle. The third state is the secured state; access is denied via the external and internal handles. A release lever connected to the control lever transfers the pawl into the release position when actuated by an access-authorized handle.

18 Claims, 6 Drawing Sheets

ROTARY LATCH LOCK, ESPECIALLY FOR MOTOR VEHICLES

BACKGROUND OF THE INVENTION

The invention relates to a rotary latch lock of the kind referred to in the claims. A high actuating comfort and a high safety of the lock require a great apparatus expenditure and increase the weight of the lock considerably.

SUMMARY OF THE INVENTION

It is an object of the invention to provide a reliable lock of a simple configuration which is characterized by an especially minimal weight. In spite of this, the actuation should be very reliable even when the electrical current supply provided for a comfort actuation of the lock should fail completely. The solution to this object results from the measures indicated in the claims.

BRIEF DESCRIPTION OF THE DRAWINGS

One embodiment of the invention is illustrated in the drawings. It is shown in.

DESCRIPTION OF PREFERRED EMBODIMENTS

Figure 1:
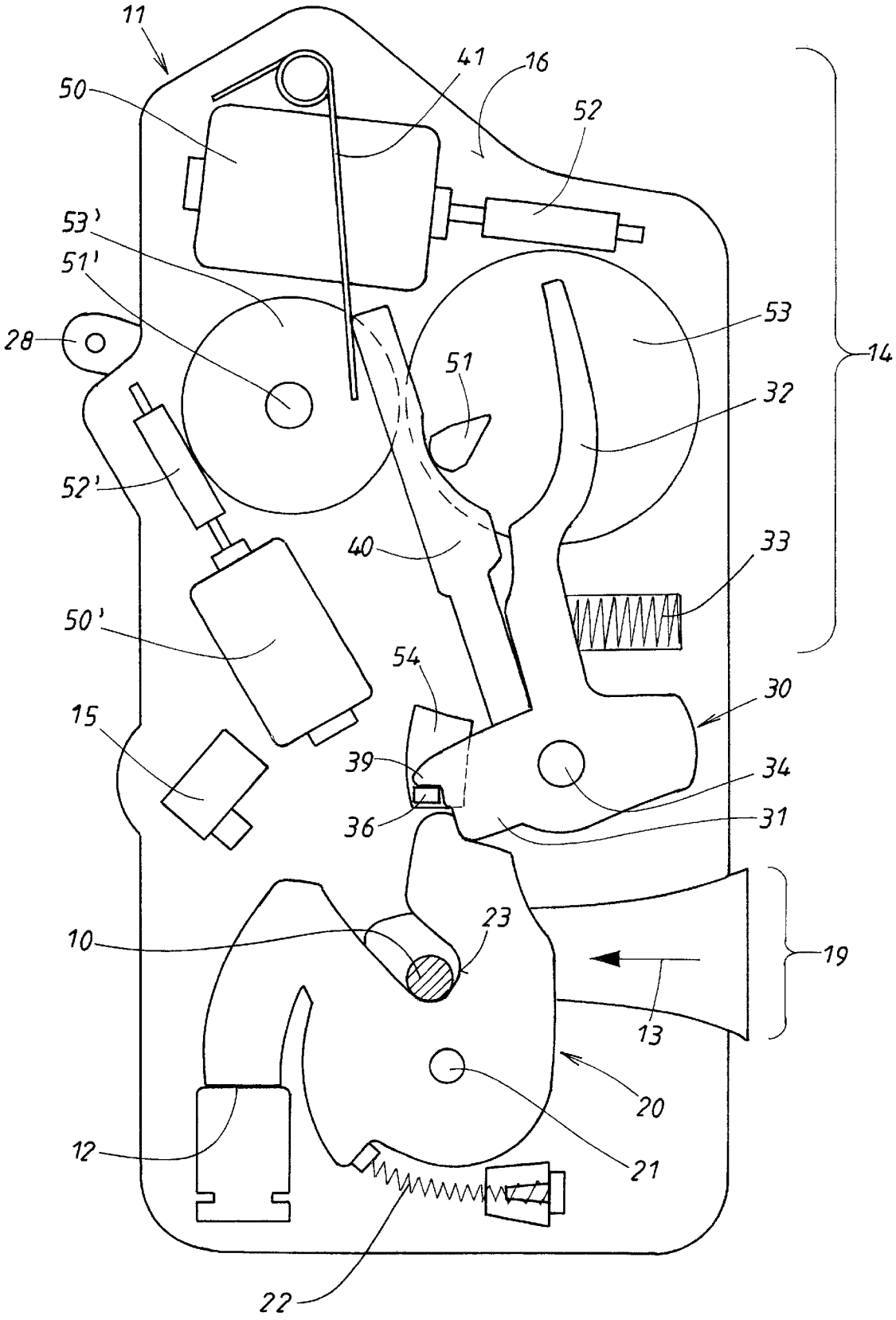
FIG. 1 a plan view onto a side of a component support receiving the components of the lock according to the invention, showing the rotary latch in the closing position in which it receives a closing member.
Figure 2:
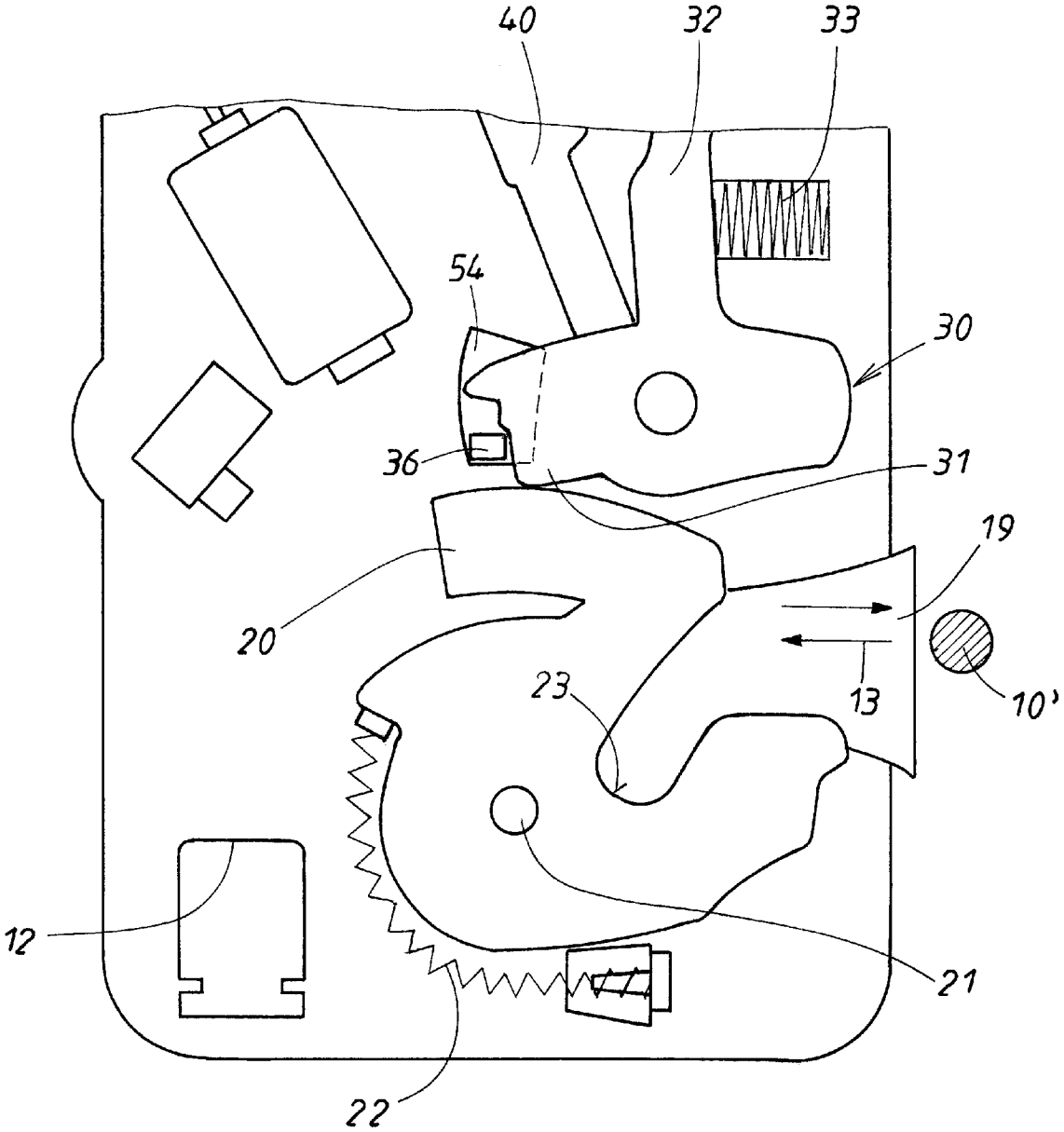
FIG. 2 a few parts of the plan view of FIG. 1 when the lock is in a different operative position, i.e., an open position in which the closing member is released.

FIGS. 1 and 2 show components already disclosed in the German patent application 197 25 416.0-22. These components are also used in the present invention; accordingly, the description of the aforementioned patent application applies, and reference is being had thereto. There are a closing member 10, which is illustrated in section in FIGS. 1 and 2, at the stationary door column of a vehicle body, and a rotary latch 20 seated by means of an axle 21 on a profiled, plate-shaped component support 11 which is mounted on the movable door. The rotary latch 20 is rotatable between two rotary end positions of which one is shown in FIG. 1 and the other is shown in FIG. 2. The rotary latch is spring-loaded by a return spring 22 which has the tendency to secure the rotary latch 20 in the open position illustrated in FIG. 2. The rotary latch 20 has a radial cutout 23 into which the closing member 10 moves when closing the door in the direction of arrow 13 of FIG. 2, and the rotary latch 20 is thus moved counter to the effect of the return spring 22 from the open position of FIG. 2 into the aforementioned closing position of FIG. 1. The profiled component support 11 has a channel 19 into which the closing member 10 moves upon performing its movement 13. This closing position is limited by a stop 12 on the support 11. In the closing position of FIG. 1 the closing member 10 is received in the radial cutout 23, and in the open position of FIG. 2 it is in its release position which is illustrated with 10'.

A further component of the lock is a pawl 30 comprised of two arms 31, 32 and seated on an axle 34 on the support 11. The pawl 30 is spring-loaded by a spring 33 which forces it by means of one arm 31, the working arm, against the rotary latch 20. The pawl 30 cooperates with the rotary latch 20 via this working arm 31. The other arm 32 serves to adjust the pawl 30 in different adjusting movements which are described in more detail in the aforementioned patent application 197 25 416.0-22. This includes a DC motor 50 which cooperates by means of a worm drive 52 with a worm wheel 53 that bears a control cam 51. The control cam 51 cooperates, in the manner disclosed in the aforementioned patent application, not only with the adjusting arm 32 but also with a further pre-loaded lever 40 which is loaded by a force storage means 41 comprised of a leg spring. A sensor 15 responds to certain rotary positions of the rotary latch 20 which, as explained in more detail in the aforementioned patent, cooperates with the motor 50.

Figure 3:
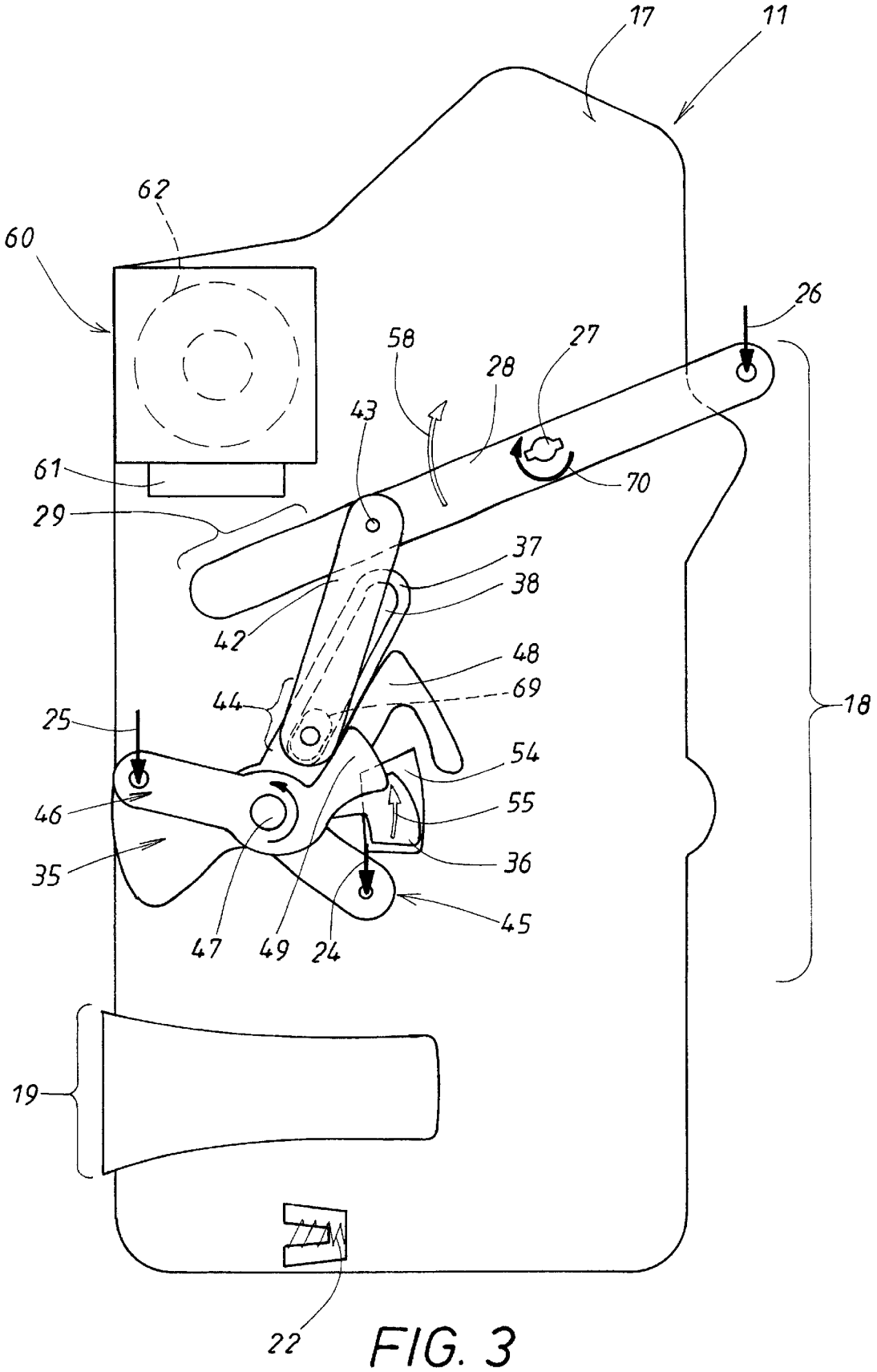
FIG. 3 the lock illustrated in FIG. 1 in a plan view onto the opposite side of the component support showing the components of the corresponding mechanical device in a first operative position.

While in FIG. 1 the electrical devices 14 provided on the one side 16 of the support 11 are arranged adjacent to the rotary latch 20 and the pawl 30, the components of a mechanical device 18 for actuating the pawl 30 are positioned on the opposite side 17 illustrated in FIG. 3. The actuations are based on different mechanical and/or electrical handles which are not represented in detail but illustrated in FIG. 3 by means of their points of action 24 through 27. These points of action 24 through 27 will be used in the following for identifying the different handles. They include an interior handle 24 provided in the interior of the vehicle; moreover, an exterior handle 25 accessible from the exterior of the vehicle; also, a safety handle 26 that can be actuated from the interior of the vehicle; and, finally, locking means, not shown in detail, actuatable from the exterior of the vehicle which by means of their rotary action 70 act on a pivot axis 27 of a control lever 28. The reference numeral 70 of this rotary movement will be used in the following also for identifying the locking means. The control lever 28 is seated fixedly on the pivot axle 27. The control lever can be pivoted between three pivot positions indicated by 28, 28', 28". A rotary axle 51' is fixedly connected to the pivot axle 27 and is arranged on the opposite side 16 of the component support 11 illustrated in FIG. 1. As can be seen in FIG. 1, a worm wheel 53' is fixedly connected to this axle 51' and driven by a worm drive 52' by means of a DC motor 50'. The actuation of the motor 50' can be effected by a remote control etc. These components 50' through 53' are motoric components of the aforementioned locking means 70 which, however, may further include also a mechanical actuation such as a cylinder core of a key-actuatable closing cylinder. Instead of the remote control device, a so-called keyless entry etc. can be used.

The control lever 28 is connected by a connecting member 42 with a release lever 35 having an angled release finger 36. The release finger 36 penetrates a cutout 54 in the component support 11 and projects on the other side 16 of the support 11 according to FIG. 1. The release finger 36 engages behind a nose 39 provided on the pawl 30. The connecting member 42 is pivotably connected at 43 to the control lever 28 and glides with a sliding block 46 provided on its other end 44 in a longitudinal guide which is embodied as a gate provided in one arm 37 of the release lever 35.

In addition to the release lever 35 two actuating levers 45, 46 are provided, i.e., an inner actuating lever 45 connected to the aforementioned interior handle 24 and an actuating lever 46 cooperating with the exterior handle 25. Th e two levers 45, 46 are rotatably supported together with the release lever 35 on a common pin 47. The bearing pin 47 is advantageously coaxially positioned to the pawl axle 34 arranged on the opposite side 16 of FIG. 1.

In FIG. 3 a first pivot position 28 of the control lever is illustrated which characterizes a first state of the lock which is the so-called "closing state". In this case, access to the vehicle is authorized via the interior handle 24 as well as the exterior handle 25. This access authorization is not only realized via the mentioned electrical devices 14 of a comfort actuation but also via the mechanical device 18 shown in FIG. 3, for example, when a current supply outage occurs. By actuating one of the two handles illustrated by their points of action 24, 25, the corresponding actuating lever 45, 46 is pivoted. Both levers 45, 46 have working arms 48, 49 which, upon counter-clockwise pivoting of the levers 45, 46, impact the end of the connecting member 42 and entrain it. The end 44 of the connecting rod 42 seated in the longitudinal guide 38 is thus a "driver". This results in a rotation of the release lever 35 in the direction of arrow 55 of FIG. 3. The release finger 36 engages the nose 39 of the pawl 30 illustrated in FIG. 1 and moves it into the release position illustrated in FIG. 2. The release lever 35 and the actuating levers 45, 46 are subjected to a spring force, not shown in detail, which has the tendency to return them into the initial position of FIG. 3. Upon actuation of the interior and exterior handles 24, 25, the control member 28 can remain in the rest position, even though the connecting member 42 pivotably connected thereto is entrained by means of its driver end 44 upon rotation 55 of the release lever 35.

Figure 4:
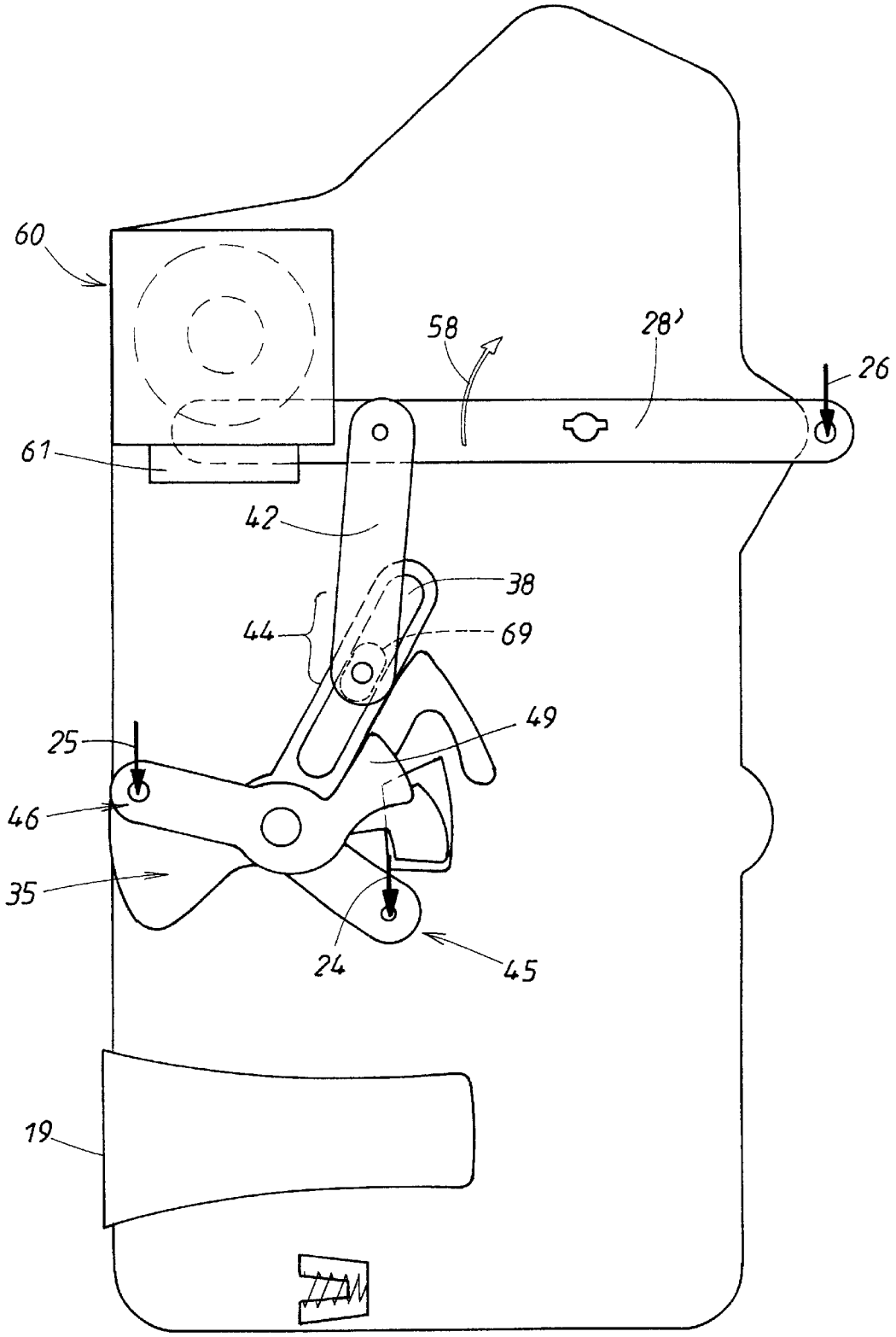
FIGS. 4 and 5 the same illustration as in FIG. 3 with the components being in two other operative positions.

The point of action 26 for the safety handle is located at one end of the control lever 28. Upon actuating this safety handle 26, which, as mentioned above, is located within the interior of the vehicle, the control lever is moved into the second pivot positioned 28' illustrated in FIG. 4. This corresponds to a second state of the lock which is the locked position. In this case, the exterior handle 25 no longer has access authorization. In this second pivot position 28' of the control lever, the driver 44 has been moved in the longitudinal guide 38 of the release lever 35 such that it is no longer aligned with the working arm 49 of the exterior actuating lever 46. Upon actuation of the lever 46, the working arm 49 cannot engage. This movement into the pivot position 28' can also be imparted to the control lever by means of the aforementioned locking means 70 engaging the pivot axle 27, for example, by means of a closing cylinder or a remote control device which can be operative via the motor 50'.

Figure 5:
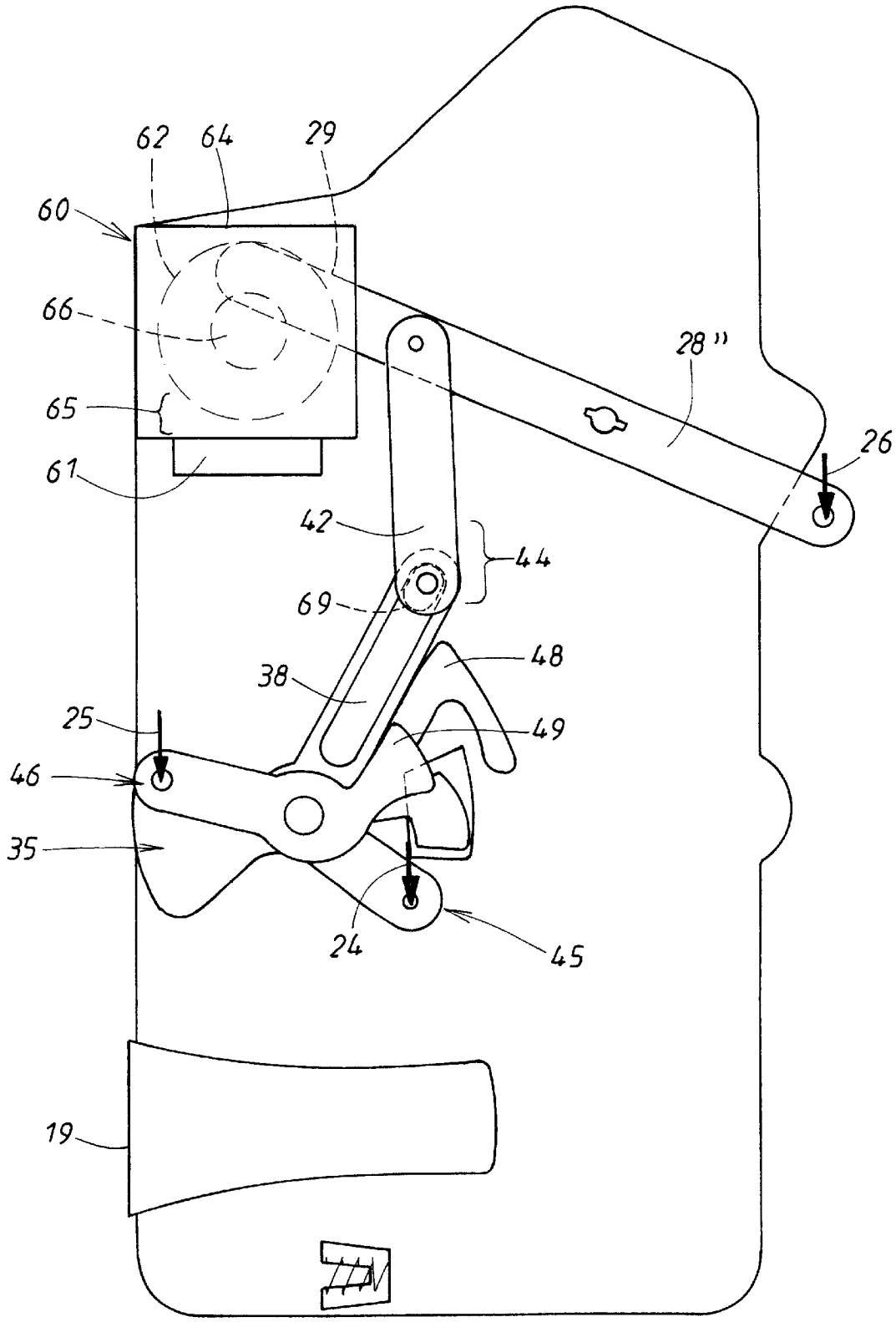

The lock according to the invention has moreover also a third state, illustrated in FIG. 5, in which the two handles 24, 25 no longer have access authorization; this is a "secured state" of the lock. In this secured state the control lever would have to be moved into the third pivot position 28" illustrated in FIG. 5. This can only be achieved from the exterior of the door by the locking means 70 acting on the pivot axle 27. These locking means 70 moreover deactivate a rotary stop 57, illustrated in FIG. 6, relative to the control lever. The rotary stop 56 is normally in the operative position illustrated in FIG. 6 and projects into the movement path 58 of the control lever between the second and third pivot positions 28', 28". Reference numeral 57 indicates a surface of the component support 11 in FIG. 6 which can serve as a gliding guide of the control lever between its different pivot positions 28, 28', 28". The rotary stop 56 can extend up to the surface 57 and, if needed, can penetrate it to a greater or lesser extent. When performing its pivot movement 58, the control lever 28' thus impacts with its lever end 59 on the stop 56. Accordingly, the further movement 58 into the third pivot position 28" is prevented. This movement 58 is only possible when a control device 60 has deactivated the rotary stop 56. The rotary stop 56 is then positioned at a spacing relative to the surface 57 of FIG. 6 so that the control lever can be moved easily from the second position 28' into the position 28".

Figure 6:
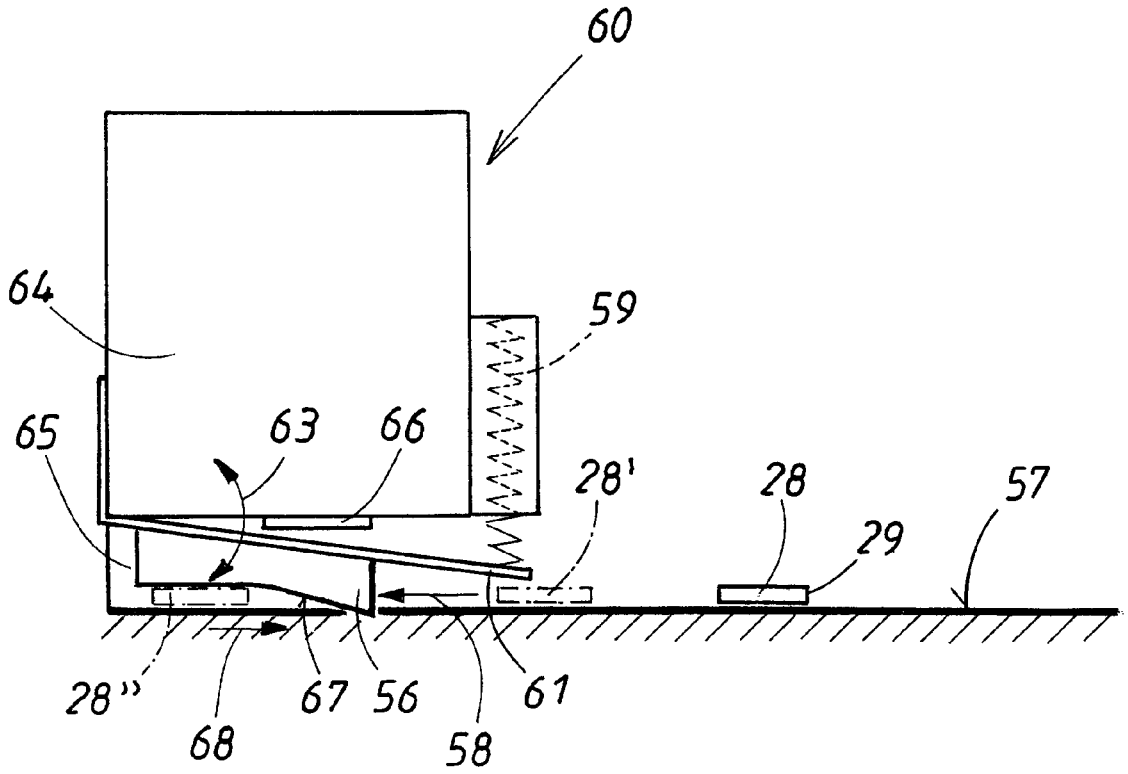
FIG. 6 a detail of the lock in a schematic illustration.

The control device 60 in the present case is comprised of a solenoid with an armature 61 that is liftable or pivotable. In the shown embodiment according to FIG. 6, the armature is comprised of an armature 61 which can be pivoted in the direction of arrow 63 and is loaded by a return spring 59. The return spring 59 pivots the armature 61 away from the solenoid 60. At the outer side of the armature 61 a rotary stop 56 is provided which, as shown in FIG. 6, can be profiled. The solenoid 60 is integrated into the plastic material 64 of the support. The coil member 62 of the solenoid 60 is surrounded by the wall parts 65 of the plastic material 64 and receives in its interior a coil core 66 that cooperates magnetically with the armature 61. Only when the solenoid 60 is switched on by the locking means that can be actuated from the exterior of the vehicle, is it possible to lift the armature 61 against the effect of the return spring 59. Only then the lever end 29 can move into the third pivot position 28" of FIG. 5 in the working gap below the solenoid 60. This is illustrated in dashed lines in FIG. 6.

As is apparent, the switching of the lock from the locked position according to the second pivot position 28' into the secured position according to the third pivot position 28" is possible only electrically in the illustrated embodiment. It must be possible to supply the solenoid 60 with current. However, a mechanical solution is also used, in that, for example, a closing cylinder is acting on the pivot axle 27. In the third pivot position 28" the lever end can be maintained in its desired end position by the profiling illustrated on the underside 67, as shown in FIG. 6, of the rotary stop 56 or the armature member 61. For this purpose, the armature 61 is again positioned in its blocking position. By means of the return spring 59, the profiled underside 67 of the armature 61 is forced against the control lever positioned in the position 28" which is then supported on the surface 57 of FIG. 7.

Expediently, a return movement of the control lever indicated by arrow 68 in FIG. 6 from the third pivot position 28" into the second pivot position 28' is possible at any time, independent of whether the locked position of the rotary stop 56 shown in FIG. 6 is present or not. The inoperative position of the rotary stop 56, as disclosed above, would require an electromagnetic control of the control device 60. However, the latter would require current to be supplied to the solenoid, which could be unavailable in an extreme case, for example, outage of the current source. In the embodiment of FIG. 6 the armature 61 is provided with a profile 67 at its underside with the rotary stop 56, wherein the profile has an ascent slant. Accordingly, the control lever can be mechanically returned from the third pivot position 28", for example, by means of the closing cylinder mentioned already several times which engages the pivot axle 27, into the second pivot position 28'. The lever end ascends on the slanted profile 67 and thus lifts the rotary stop 56 against the effect of the return spring 59 upwardly by a sufficient amount and glides underneath. With the same means the control lever can also be returned into the first pivot position 28 according to FIG. 3 which corresponds to the closing state of the lock. In this case, access to the vehicle is also possible by means of the exterior handle; the door can be opened.

According to the invention, opening of the rotary catch is possible usually by means of the electric devices 14 illustrated in FIG. 1. If needed, it is also possible to employ mechanical components which are disclosed in FIGS. 3 through 6 in the form of the device 18. Accordingly, the system is not dependent on the current supply of the vehicle which is conventionally used for the comfort actuation of the rotary latch lock; even when the electrical supply fails, the rotary latch positioned in its closed position can be easily mechanically transferred into the open position of FIG. 2 by means of the device 18. Important in this context is the compact configuration and the inexpensive manufacture and assembly of the components which result especially from the integration of the control device 60 during manufacture of the component support 11 of plastic material 64. The rotary latch lock according to the invention is characterized by a surprisingly minimal weight even through it has the aforementioned multi-function motoric comfort actuation.

LIST OF REFERENCE NUMERALS

10 closing member (receiving position in 20)
10' release position of 10 (FIG. 2)
11 component support
12 stop for 20 in 11
13 part of the locking movement of 10' in 10 (FIG. 2)
14 electric devices on 16 of 11
15 sensor for 20
16 one side of 11 for 17
17 other side of 11 for 18
18 mechanical device of 11
19 channel in 11 for 10
20 rotary latch
21 axle of 20
22 return spring for 20
23 radial cutout in 20 for 10
24 point of action for interior handle
25 point of action for exterior handle
26 point of action for securing handle
27 slanted axle of 28
28 control lever (first pivot position)
28' second pivot position of 28
28" third pivot position of 28
29 lever end of 28
30 pawl
31 working arm of 30
32 adjusting arm of 30
33 spring for 30
34 axle of 30
35 release lever for 18
36 release finger of 35 for 18
37 arm of 35
38 longitudinal guide, gate
39 nose of 30 for 36
40 pre-loaded lever
41 force storage means for 40
42 connecting member between 28, 35
43 pivot connection of 42 at 28
44 end of 42, driver
45 interior actuating lever for 44
46 exterior actuating lever for 44
47 bearing pin of 45, 46, 35
48 working arm of 45
49 working arm of 46
50 DC motor for 32 and 40
50' DC motor for 27
51 control cam on 53
51' axle of 531
52 worm drive of 50
52' worm drive of 50'
53 worm wheel of 50
53' worm wheel of 50'
54 cutout in 11 for 36
55 arrow of rotary movement of 35 by 45 or 46
56 rotary stop on 61 (FIG. 6)
57 gliding guide surface on 11 for 28
58 movement path of 28' in 28"
59 return spring for 61
60 control device, solenoid
61 armature of 60
62 coil member of 60
63 arrow of pivot movement of 61
64 plastic material of 11
65 wall part of 64 for 60
66 coil core of 60
67 underside profile of 56
68 arrow of return movement from 28" to 28'
69 sliding block at 44
70 locking means on 27

What is claimed is:

1. A rotary latch lock for a vehicle, arranged between two vehicle parts, one of the vehicle parts being movable and the other vehicle part being stationary, the rotary latch lock comprising:

a rotary latch (20) and a closing member (10) connected opposed to one another on one of the two vehicle parts, respectively, the closing member (10) cooperating with the rotary latch (20), wherein the rotary latch (20) is configured to be rotatable between a closing position in which the rotary latch receives the closing member (10) and an open position in which the rotary latch releases the closing member (10'), wherein the rotary latch is configured to be spring-loaded toward the open position;

a pivotable pawl (30) configured to be spring-loaded (33) toward a locking position, wherein in the locking position the pivotable pawl secures the rotary latch (20) in the closing position, wherein the pivotable pawl has a release position in which release position the pivotable pawl releases the rotary latch;

handles (24, 25, 26) configured to transfer the pivotable pawl (30) by a one or more drive devices into the release position releasing the rotary latch (20), wherein the handles comprise an interior handle (24) arranged in the interior of the vehicle, an exterior handle (25) positioned externally to the vehicle, a safety handle (26) actuatable from the interior of the vehicle, and locking means (70) actuatable from the exterior of the vehicle;

a common control lever (28) configured to switch the lock between first, second, and third states by pivoting between first, second, and third pivot positions, and wherein the safety handle (26) and the locking means (70), when actuated, are configured to act on the common control lever;

wherein the first state is the closing state of the lock and the common control lever is in the first pivot position (28), wherein in the first state access to the vehicle is authorized via the interior handle (24) and via the external handle (25), wherein the second state is the locking state of the lock and the common control lever is in the second pivot position (28'), wherein in the second state access via the exterior handle (25) is denied;

wherein the third state is the secured state of the lock and the common control lever is in the third pivot position (28"), wherein in the third state access via the external handle (27) and the internal handle (24) is denied;

a release lever connected to the common control lever (28), wherein the release lever, when actuated by one of the handles (24 through 26) authorized to provide access to the vehicle, transfers (55) the pivotable pawl (30) into the release position.

2. The lock according to claim 1, further comprising:

two actuating levers, wherein a first one of the two actuating levers is an interior actuating lever (45) connected to the interior handle (24) and wherein a second one of the two actuating levers is an outer actuating lever (46) connected to the outer handle (25);

a driver (44) guided (38, 69) on the release lever (35) and connected (42) to the common control lever (28);

wherein the common control lever, when in one of the first, second, and third pivot positions (28, 28', 28"), is configured to move the driver (44) into a first, second, and third driver position, respectively;

wherein the driver (44) in the first driver position is aligned with the two actuating levers, in the second driver position is aligned with one of the two actuating levers, and in the third driver position is aligned with none of the two actuating levers (45, 46);

wherein in the second driver position the driver (44) receives a working movement of the aligned actuating lever (45 or 46) and transmits it onto the release lever (35), and the release lever then pivots (55) the pivotable pawl (30) into the release position.

3. The lock according to claim 2, wherein the driver comprises a connecting member (42) having a first end connected to a gate (38, 69) of the release lever (35) and second end connected (43) to the common control lever (28).

4. The lock according to claim 2, comprising a bearing pin (47) on which the two actuating levers (45, 46) are seated.

5. The lock according to claim 4, wherein the release lever (35) is seated on the bearing pin (47).

6. The lock according to claim 4, wherein the bearing pin (47) is coaxial to an axle (34) of the pivotable pawl (30).

7. The lock according to claim 1, comprising a multi-functional component support (11), wherein a first one of the one or more drive devices is a mechanical device arranged on a first side (17) of the component support (11) and wherein the rotary latch (20) and the pivotable pawl (30) are arranged on a second side (16) of the component support (11), wherein the release lever (35) has an angled release finger (36) and penetrates with the release finger (36) a cutout (54) provided in the component support (11), wherein the pivotable pawl (30) has a nose (39) and the release finger (36) engages behind the nose (39) of the pivotable pawl (30).

8. The lock according to claim 7, wherein a second one of the one or more drive devices is a motoric device arranged on the second side (16) of the component support (11), wherein the motoric device (14) is configured to return the pivotable pawl (30) into a ready position, wherein the pivotable pawl (30), when closing the door of the vehicle, is moved from the ready position into the locking position.

9. The lock according to claim 1, wherein the locking means (70) acts on a pivot axle (27) of the common control lever (28) and pivots (58) the common control lever (28), wherein the common control lever (28) has a first lever end connected to the safety handle (26) and a second lever end (29) configured to be locked (29) as needed.

10. The lock according to claim 1, further comprising a control device (60) and a rotary stop (56), wherein the control device (60) is configured to move the rotary stop (56) into an activated position or a deactivated position, wherein the rotary stop (56), when in the activated position, projects into a movement path (58) of the common control lever (28) so that pivoting of the common control lever (28) between some of the first, second, and third pivot positions (28', 28") is blocked, and wherein the rotary stop (56), when in the deactivated position, is moved out of the movement path (58) of the common control lever (28).

11. The lock according to claim 10, wherein the rotary stop (56), when in the activated position, prevents the common control lever (28) from reaching the third pivot position (28") from the second pivot position (28').

12. The lock according to claim 11, wherein the common control lever (28) is configured to return from the third pivot position (28") into the second pivot position (28') even when the rotary stop (56) is in the activated position.

13. The lock according to claim 10, wherein the rotary stop (56) is force-loaded into the activated position in the movement path (58) and wherein the control device (60) is configured to move the rotary stop (56) against the force load (59) into the deactivated position.

14. The lock according to claim 10, wherein the control device is a solenoid (60) with an armature (61) and wherein the rotary stop (56) is connected to the armature (61) of this solenoid (60).

15. The lock according to claim 14, wherein the solenoid (60) is integrated into the component support (11).

16. The lock according to claim 15, wherein the component support (11) is comprised of plastic material (64) and wherein the solenoid has a coil member (62) connected to wall parts (65) of the component support (11).

17. The rotary latch lock according to claim 1, wherein the one or more drive devices are selected from the group consisting of a mechanical device, a motoric device, and an electro-motoric device.

18. The rotary latch lock according to claim 1, wherein the locking means is a closing cylinder configured to be actuated by a key, a remote control device, or a keyless entry.

* * * * *